US009051164B2

(12) United States Patent
Aehle et al.

(10) Patent No.: US 9,051,164 B2
(45) Date of Patent: Jun. 9, 2015

(54) DISPENSING VALVE

(71) Applicants: Achim Aehle, Bordesholm (DE); Stefan Kunter, Hamburg (DE); Matthias Fedde, Hamburg (DE)

(72) Inventors: Achim Aehle, Bordesholm (DE); Stefan Kunter, Hamburg (DE); Matthias Fedde, Hamburg (DE)

(73) Assignee: Elaflex Hiby Tanktechnik GmbH & Co. KG, Hamburg (DE)

( * ) Notice: Subject to any disclaimer, the term of this patent is extended or adjusted under 35 U.S.C. 154(b) by 221 days.

(21) Appl. No.: 13/631,223

(22) Filed: Sep. 28, 2012

(65) Prior Publication Data

US 2013/0087247 A1 Apr. 11, 2013

(30) Foreign Application Priority Data

Sep. 30, 2011 (EP) ..... 11183399

(51) Int. Cl.
*B67D 7/04* (2010.01)
*B67D 7/42* (2010.01)

(52) U.S. Cl.
CPC ... *B67D 7/04* (2013.01); *B67D 7/42* (2013.01)

(58) Field of Classification Search
USPC ..... 141/94, 363, 392
See application file for complete search history.

(56) References Cited

U.S. PATENT DOCUMENTS

| | | | | |
|---|---|---|---|---|
| 2,113,853 | A | 4/1938 | Nicholson | |
| 2,826,455 | A * | 3/1958 | Furton | 222/505 |
| 7,040,358 | B2 * | 5/2006 | Lacroix et al. | 141/206 |
| 2005/0061397 | A1 | 3/2005 | Mendicino et al. | |
| 2011/0186176 | A1 * | 8/2011 | Aehle et al. | 141/350 |
| 2013/0081738 | A1 * | 4/2013 | Fedde et al. | 141/311 R |

FOREIGN PATENT DOCUMENTS

| | | |
|---|---|---|
| DE | 819366 | 10/1951 |
| FR | 829352 | 6/1938 |
| GB | 1420358 | 1/1976 |

OTHER PUBLICATIONS

EPO Machine Translation of FR 829352, published Jun. 24, 1938.
EPO Machine Translation of DE819366, published Oct. 31, 1951.

* cited by examiner

*Primary Examiner* — Nicolas A Arnett
(74) *Attorney, Agent, or Firm* — Casimir Jones, S.C.

(57) ABSTRACT

The invention relates to a dispensing valve for dispensing liquids into a reservoir container, with a main valve and with an operating lever designed for opening the main valve against a force biasing the main valve into the closed position, wherein the valve actuation mechanism has a continuous characteristic with a smooth profile, with which, when subjecting the operating lever to an actuation force at the start of a valve opening stroke, a different opening force is exerted on the main valve than when subjecting the operating lever to the same actuation force during the later course of the valve opening stroke.

20 Claims, 7 Drawing Sheets

DISPENSING VALVE

CROSS-REFERENCE TO RELATED APPLICATIONS

This application claims the benefit of European Application No. 11183399.2, filed Sep. 30, 2011, which is incorporated herein by reference in its entirety.

BACKGROUND OF THE INVENTION

The invention relates to a dispensing valve for dispensing liquids into a reservoir container. The fuelling of in particular small aircraft is carried out with so-called airfield refuelling valves, with which fuel is dispensed into filling openings frequently located on the upper side of the wings (overwing fuelling). Carrying out such overwing fuelling is demanding and requires the application of significant force because, on the one hand, the dispensing valve together with the filling hose has to be moved into the necessary overwing position and, on the other hand, safety regulations prohibit the use of an airfield refuelling valve with a locking mechanism that retains the operating lever, and thereby retains the valve in the open state without using manual force. Thus, the dispensing valve and the operating lever must be held open manually during the entire refuelling process.

BRIEF SUMMARY OF THE INVENTION

The object of the invention is to provide a dispensing valve of the above-mentioned type that facilitates a refuelling process for the operator and is thus especially suitable for use as an airfield refuelling valve.

The object is achieved in that the valve actuation mechanism has a continuous characteristic with a smooth profile, wherein at the start of the valve opening stroke during application of an actuation force to the operating lever, a different opening force is exerted on the main valve than when applying the same actuation force to the operating lever during the later course of the valve opening stroke.

BRIEF DESCRIPTION OF THE DRAWINGS

Example embodiments of the invention are described below using the figures. The figures show.

DETAILED DESCRIPTION OF THE INVENTION

Figure 1:
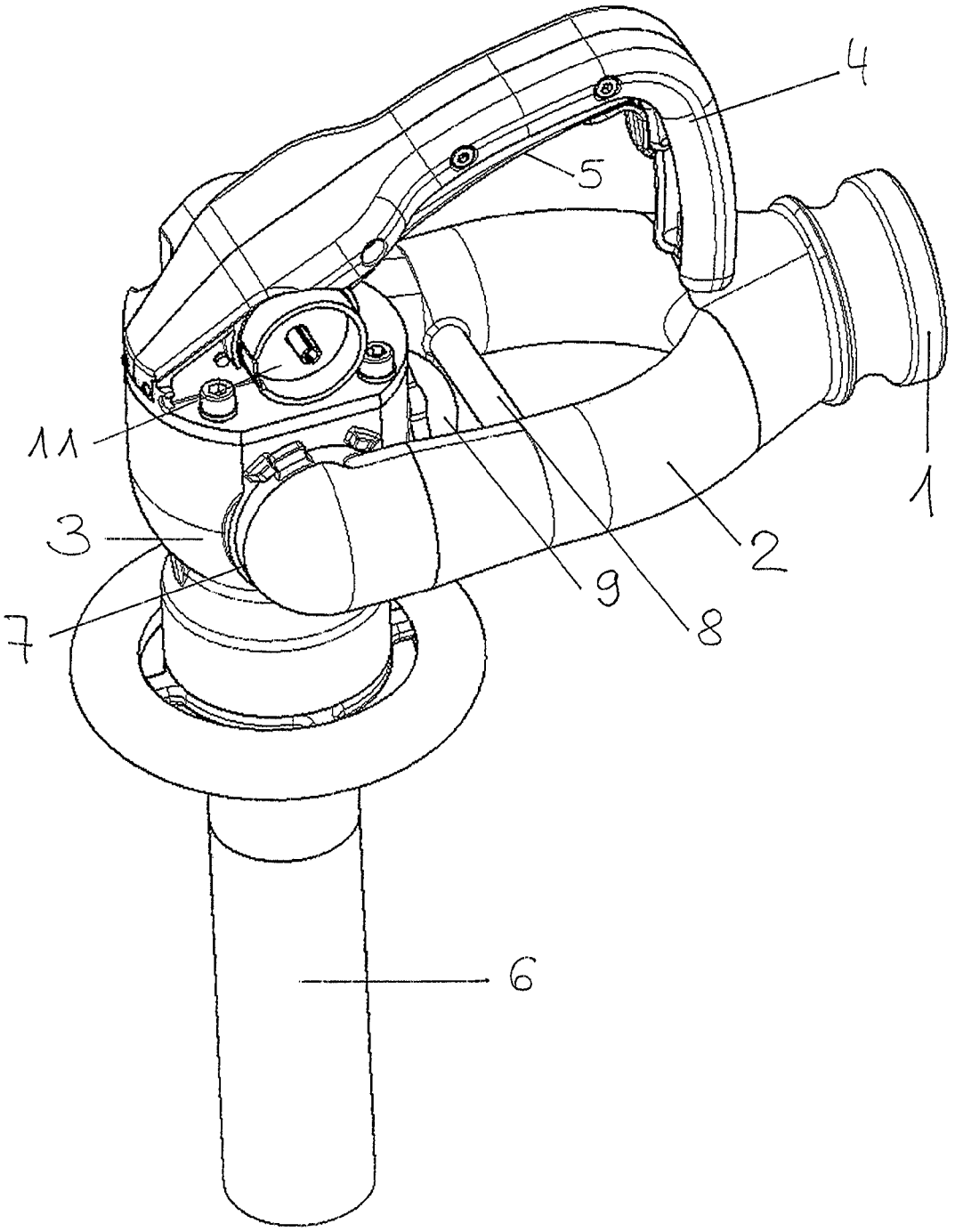
FIG. 1 a view of a dispensing valve according to the invention.

First, some terms used in the context of the invention are explained. The dispensing valve according to the invention is designed for dispensing liquids into a reservoir container, in particular fuels or other operating liquids. The reservoir container can in particular be a fuel tank, for example the fuel tank of an aircraft or a different vehicle. The main valve dispenses the liquid delivery. The operating lever (also known as the switching lever) is used to actuate the main valve. The main valve is biased into the closed position, in which it stops the liquid delivery. The bias into the closed position is normally effected by a spring force.

According to the invention, it is provided that the valve actuation mechanism has a continuous characteristic with a smooth profile. At the start of the valve opening stroke (and thus at the start of the actuation displacement of the operating lever) the application to the operating lever of a defined actuation force causes a different opening force on the main valve than when exerting the same actuation force over the continuing course of the valve opening stroke (and thus the actuation displacement of the operating lever). The opening force at the start of the valve opening stroke can be larger or smaller than the opening force during the later course of the valve opening stroke.

A modified displacement ratio correlates with the change in the opening force. For a defined valve stroke at the start of the valve opening process, a longer or shorter actuation displacement of the operating lever is necessary than for the same valve stroke during the later course or towards the end of the valve opening process. The change of the opening force or of the ratio of the displacement during the course of the valve opening stroke takes place continuously here, i.e. no jumps occur in the necessary opening force or the displacement ratio.

The invention resolves the apparent conflict for a dispensing valve of, on one hand, preventing high actuation forces for the operating lever while, on the other hand, simultaneously enabling a small lever displacement. In the case of a typical type of dispensing valve, the lifting force required to open the main valve at the point in time of the start of the opening process can be at a maximum, because at this point in time there is still no flow through the valve and the full pressure difference between the inflow and discharge sides of the valve is acting on the valve disk and is forcing it into the closed position in addition to the spring force.

According to the invention, the actuation force on the operating lever necessary in order to overcome the initial resistance can be reduced here by the provision of a greater ratio of the lever displacement to the valve stroke displacement. After the start of valve opening, the pressure difference across the valve reduces as a result of the liquid flow and the necessary lifting forces for further opening of the main valve are reduced. According to the invention, a smaller ratio of the lever displacement to the valve stroke displacement can then be provided. The actuation force on the operating lever can remain approximately the same, but the lever displacement until reaching the fully open position of the main valve is reduced by the now modified force ratio. For full valve opening, a relatively small lever displacement is necessary, but only a relatively small actuation force is necessary at the start of the opening process because of the larger ratio. This facilitates the operation of a suitable valve, in particular in the case of its use as an airfield refuelling valve in overwing operation.

According to the invention, however, it is also possible to design the dispensing valve in such a way that a large opening force is necessary at the start of the valve opening stroke, which reduces during the later course of the valve opening stroke. In this way, a possibly desirable initial resistance during opening of the valve is ensured, without this initial resistance persisting during the later course of the valve opening stroke.

Preferably, the operating lever and the valve actuation mechanism of the main valve (preferably the valve rod) are kinematically connected via a linkage mechanism whose gear ratio varies during the course of the actuation displacement of the operating lever. This ratio is variable in such a way that at the start of the opening stroke of the valve a higher or lower ratio of lever displacement to valve displacement takes place than during the later course or towards the end of the opening stroke.

Various designs of said linkage mechanism are conceivable. With a first preferred embodiment of the invention, the linkage mechanism is a coupled linkage mechanism, which comprises a drive lever linked to the operating lever, whose first actuation end has an operative connection to the valve rod of the main valve. The drive lever preferably comprises a second end, which is linked to the first end of a linkage lever, whose second end is in turn linked to a fixed portion of the dispensing valve. During the course of the actuation of the operating lever, the angular position of the drive lever changes in a manner that is explained in detail in the example embodiments and acts in such a manner that the actuation end of the drive lever pivots in the opening direction of the valve rod. This pivoting motion of the drive lever acts on the operating lever via a rotation or pivoting about the linkage axis, which additionally moves the actuation end of the drive lever in the opening direction of the main valve and so increases the actuation displacement of the valve and thus the effectively utilized valve stroke. The coupled linkage mechanism can be designed in such a way that the effectively utilized valve stroke is reduced.

According to the invention, it can be provided that the first actuation end of the drive lever has an essentially linear guide. The operating lever normally pivots about an axis when actuated and thus carries out a circular segment motion. The drive lever can pivot in the opposite direction about its linkage axis to the operating lever. The radii of the two opposed circular arcs can be formed in such a manner that as a result the actuation end of the drive lever performs an essentially linear movement in the direction of the opening stroke of the valve. This enables a particularly efficient, low friction and low wear opening of the main valve, because there are no or at most low frictional forces affecting the operative connection between the actuation end of the drive lever and the valve rod.

In the case of a different embodiment of the invention, the linkage mechanism can comprise a rocker arm. This preferably comprises a linkage point and an actuation end that is preferably remote from the linkage point. The rocker arm is preferably raised by an actuating element of the operating lever, whereby during the course of actuation of the operating lever, said actuating element moves along the rocker arm towards or away from its linkage point, and thus a defined displacement of the operating lever over the later course of the opening process causes a correspondingly larger or smaller displacement of the actuation end of the rocker arm as a result of the modified lever ratio.

Airfield refuelling valves must generally comprise an earthing cable, with which an earth connection is made to the aircraft prior to the start of the refuelling process. Furthermore, a covering cap is generally provided for protection of the dispensing end or discharge opening when not in use. In an advantageous variant of the invention, it can be provided that the earthing cable comprises an automatic retraction system. This can in particular be a rewinding roller biased into the rewound position. In this way, following the completion of a refuelling process, the earthing cable can be automatically rewound and does not prevent further operation of the dispensing valve. The protective cap can, according to the invention, be connected to the dispensing valve by means of a cord and an automatic retraction system may also be provided for this cord. An automatic retraction system of this type has the further advantage, that for example for overwing fuelling when inserting or removing the dispensing valve there are no cable or cord ends hanging loose on the dispensing valve, which can sometimes interfere with the operation or potentially lead to damage to the wing surface or its paintwork.

In an advantageous embodiment of the invention, the valve body comprises two mutually diametrically opposed inlets, which are connected to two inlet portions of the dispensing valve housing. The liquid feed is not provided from the end face of the valve body or valve housing opposite the dispensing opening or the discharge pipe, but rather the liquid is fed in from the side, the feed direction being preferably approximately at right angles to the stroke direction of the valve rod. The actuation mechanism including the operating lever can be disposed in proximity to the end face of the valve body opposite the discharge opening. This structural design offers a series of advantages. For one thing, the described "kinking" of the feed direction relative to the dispensing direction facilitates the operation of the dispensing valve, for example in a typical overwing refuelling situation. For another thing, the relatively free arrangement of the actuation mechanism at the exposed end face of the valve body allows operation and actuation from different directions, without any adverse effect being caused by the delivery hose. The operation, and for example the overwing fuelling, are improved still further by means of delivery portions that are pivotably connected to the inlet of the valve body. In this case it is a liquid connection in the form of a rotary linkage. Said pivotability facilitates the operation still further, because the angle between the normally quite heavy and frequently inflexible feed hose and the discharge pipe can be adjusted better and thus fuelling is facilitated. The pivotability can be limited by stops and consists of only a small angular range of, for example, 10 to 15°. Alternatively, a complete rotation through 180°, for example, can be allowed if this is not prevented by the actuation mechanism on the end face of the valve body.

The inlet portions of the dispensing valve housing can preferably extend in a forked shape from the hose connection of the dispensing valve to said feeds of the valve body. The flow of liquid through the feed hose is divided in this way into two partial flows and fed to the valve body through the two diametrically opposed inlets. This facilitates higher volumetric flows through the dispensing valve. A design of this nature with large flow cross sections also reduces the pressure losses that occur.

According to the invention, it can be provided that a connecting path, preferably in the form of a liquid passage, is provided between the fork-shaped inlet portions. This increases the stability and strength of the construction and can according to the invention additionally comprise a viewing window, which enables visual monitoring of the refuelling process. The viewing window is then protected in the inner portion of the fork, disposed between the two inlet portions. Alternatively, the viewing window can be disposed in the valve body, preferably in the portion that is protected by the forked inlet portions.

Preferably, the dispensing valve has a nominal width of at least 25 mm, further preferably a range of nominal widths of 40 mm to 50 mm. The values mentioned can optionally be combined to give ranges according to the invention. Preferably, a dispensing performance of at least 150 l/min is provided for, further preferably 200, 300 or 400 l/min. A preferred maximum value of the delivery performance is 800 l/min. The values mentioned can optionally be combined to give ranges according to the invention.

It can further be provided that the dispensing valve according to the invention comprises a quick release pipe (discharge pipe).

Figure 3:
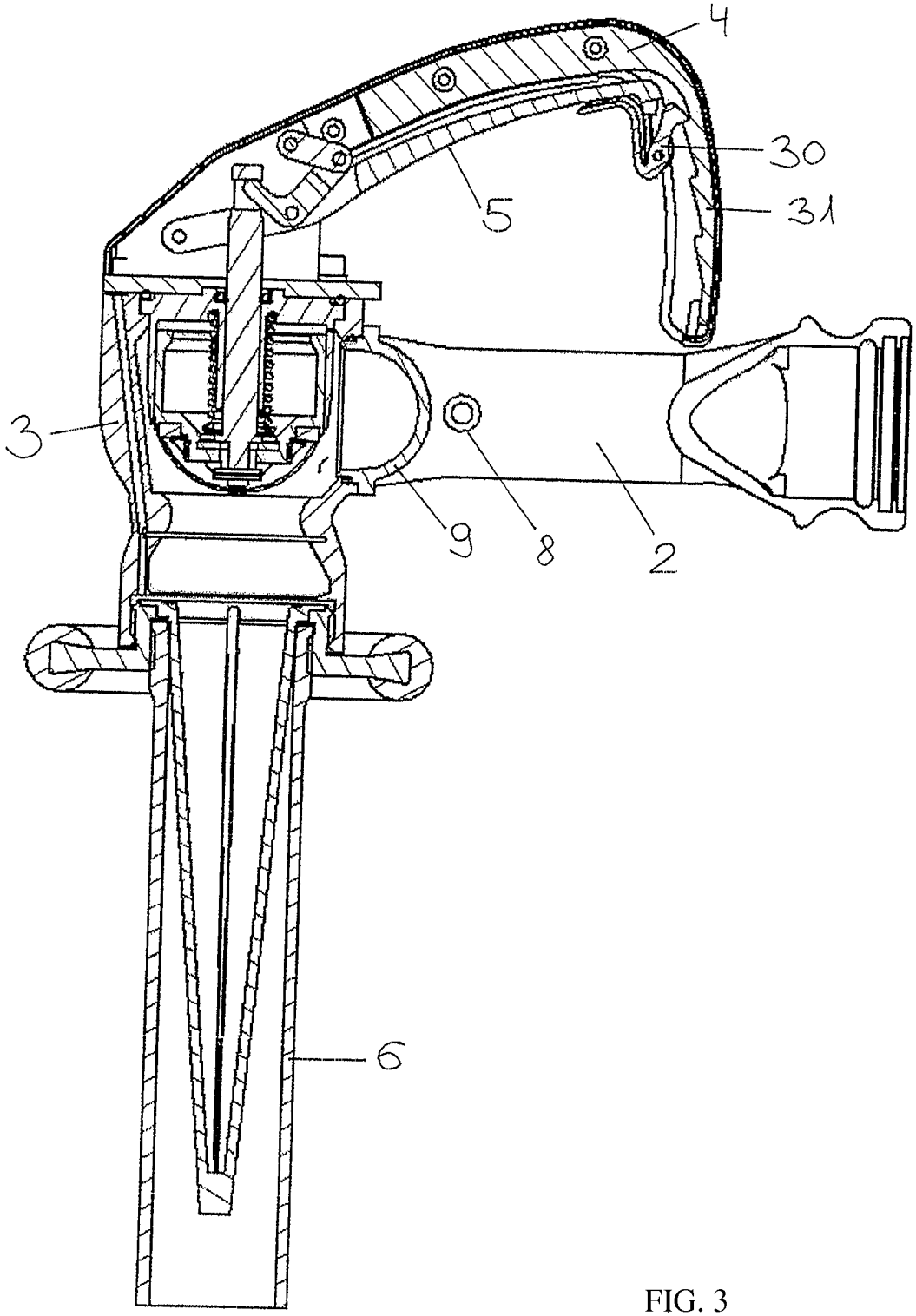
FIG. 3 a dispensing valve according to the invention in a sectional drawing.

The dispensing valve according to the invention illustrated in FIG. 1 basically comprises a hose connection 1, inlet portions 2 that spread out in a forked manner, a valve body 3, an actuation mechanism with a handle 4 and an operating lever 5 as well as a discharge pipe 6. The discharge pipe 6 is, as can be seen in FIG. 3, in the form of a quick release pipe. The valve body 3 comprises two mutually diametrically opposed liquid passages in the form of rotary linkages, at which there is a liquid flow from the inlet portions into the valve body 3. The inlet portions 2 are constructed so as to be rotatable relative to the valve body 3 about said rotary linkages 7.

The handle 4 and the actuation lever 5 are arranged opposite the discharge ends at the end face of the valve body 3. It can be seen that as a result of the design illustrated, these actuating elements can be freely grasped from all sides, because they are disposed above the hose connection 1.

A connecting path 8 (in the form of a connecting tube through which liquid can pass) is disposed between the inlet portions 2 in proximity to the valve body 3, in order to increase the stability of the dispensing valve. A viewing window denoted by 9, through which the refuelling process can be monitored, is disposed and protected in the portion of the valve body 3 enclosed by the inlet portions 2.

Figure 2:
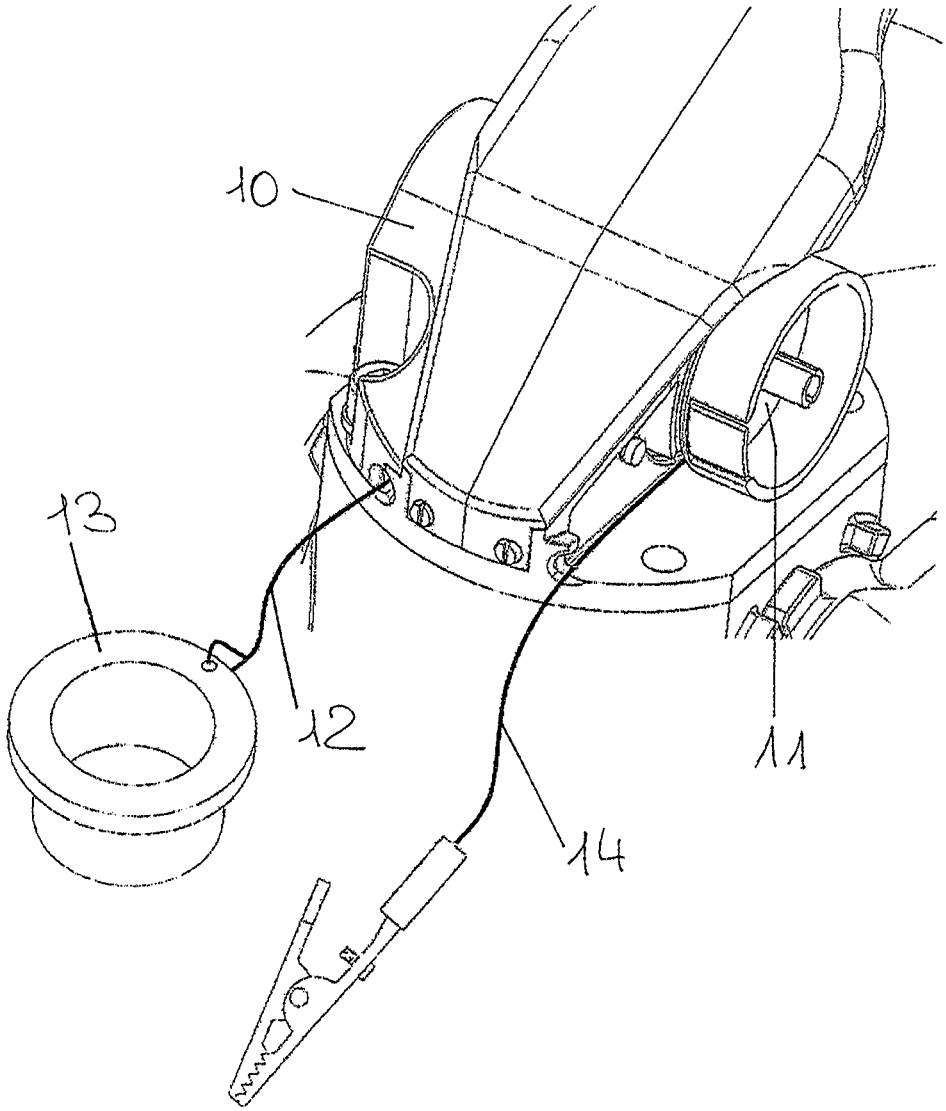
FIG. 2 a view of the automatic retraction system for the earthing cable and the cord of the protective cap.

FIG. 2 shows details of the automatic retraction system according to the invention. Two winding spools 10, 11 are disposed at the front end of the valve body 3 in proximity to the attachment of the handle 4, the spools being biased into the rewound position by means of springs that are not illustrated. A cord 12 with an attached protective cap 13 for the discharge pipe 6 can be pulled off from the spools 10, 11. In the resting state of the dispensing valve, the protective cap 13 can protect the discharge end of the discharge pipe 6. If the protective cap 13 is removed in preparation for the refuelling process, the cord 12 is rewound onto the spool 10 and the protective cap 13 is pulled onto the dispensing valve. It does not hang down and does not disturb the operation during the refuelling process. An earthing cable 14 is wound onto the spool 11 and is connected to an earth terminal. Again, the earthing cable 14 is rewound in the resting state and the earth terminal does not hang down loosely. Prior to the start of the refuelling process, a required length of the earthing cable 14 is pulled out and an earth connection is made between the dispensing valve and, for example, the aircraft.

The main valve comprises a valve disk within the valve body 3, which is in sealed contact with a valve seat 16 by means of a valve seal 15 in the closed state. The valve is held in this closed position by a valve spring 17. The valve can be moved against the force of the spring 17 into an open position by means of a valve rod 18. The valve rod 18 has a bore 19 in the end remote from the valve seat, extending transversely relative to its axis and through which the actuation end 20 of a drive lever 22 engages, which is pivotably connected by means of the pivot axis 21 to the operating lever 5. The drive lever 22 is pivotably connected via pivot axis 23 to a linkage lever 24, whose second end in turn is pivotably linked via pivot axis 25 to a fixed part of the valve body or of the handle.

The coupled linkage mechanism with variable gear ratio formed by the interworking of the operating lever 5 (with its pivot axis 26), linkage lever 24, drive lever 22 and valve rod 18 brings about the continuous valve actuation characteristic with a smooth profile according to the invention. In the illustrated case the characteristic is a progressive characteristic.

Figure 4:
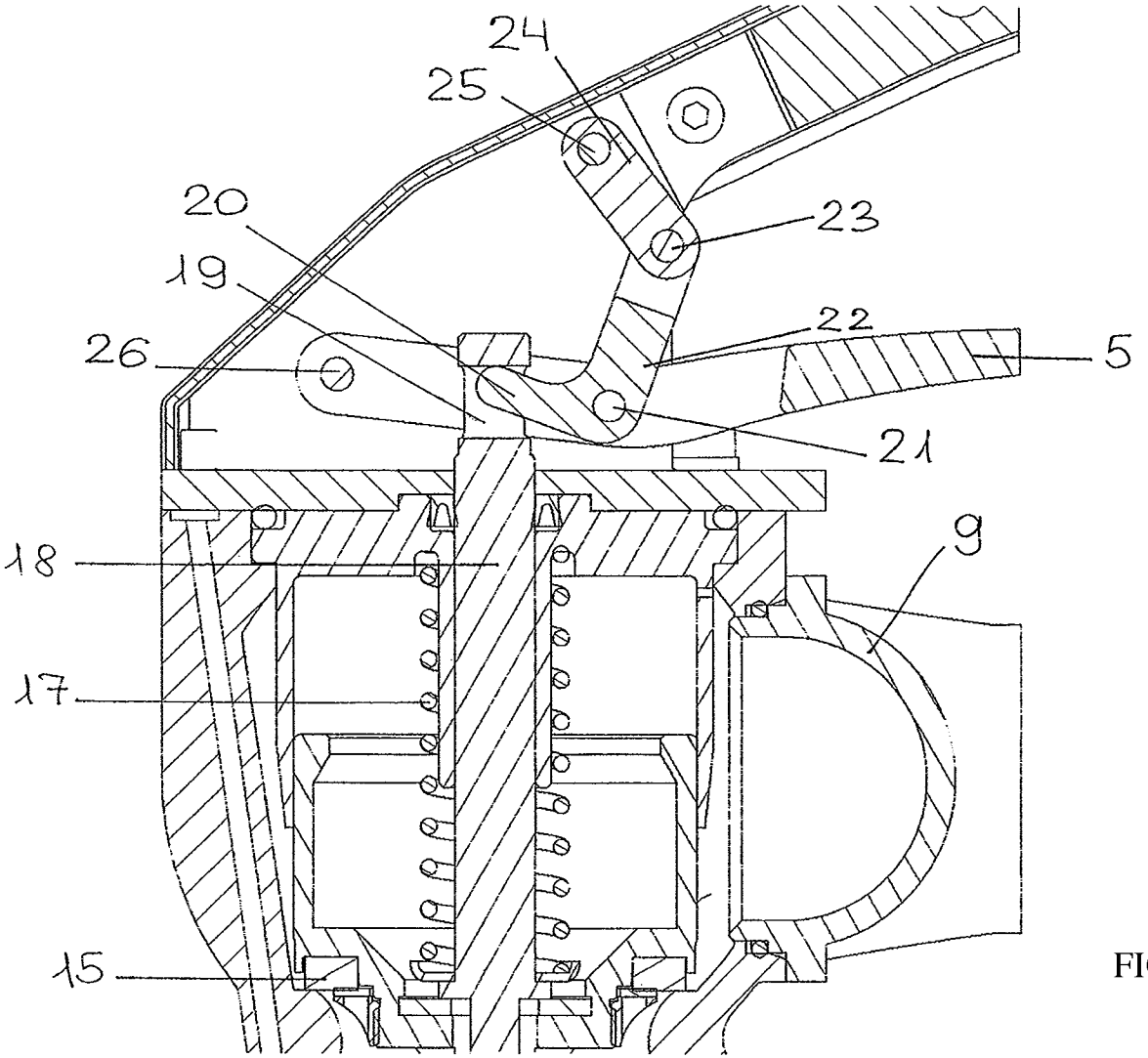
FIG. 4 in a section from FIG. 1, the dispensing valve in the closed state.
Figure 5:
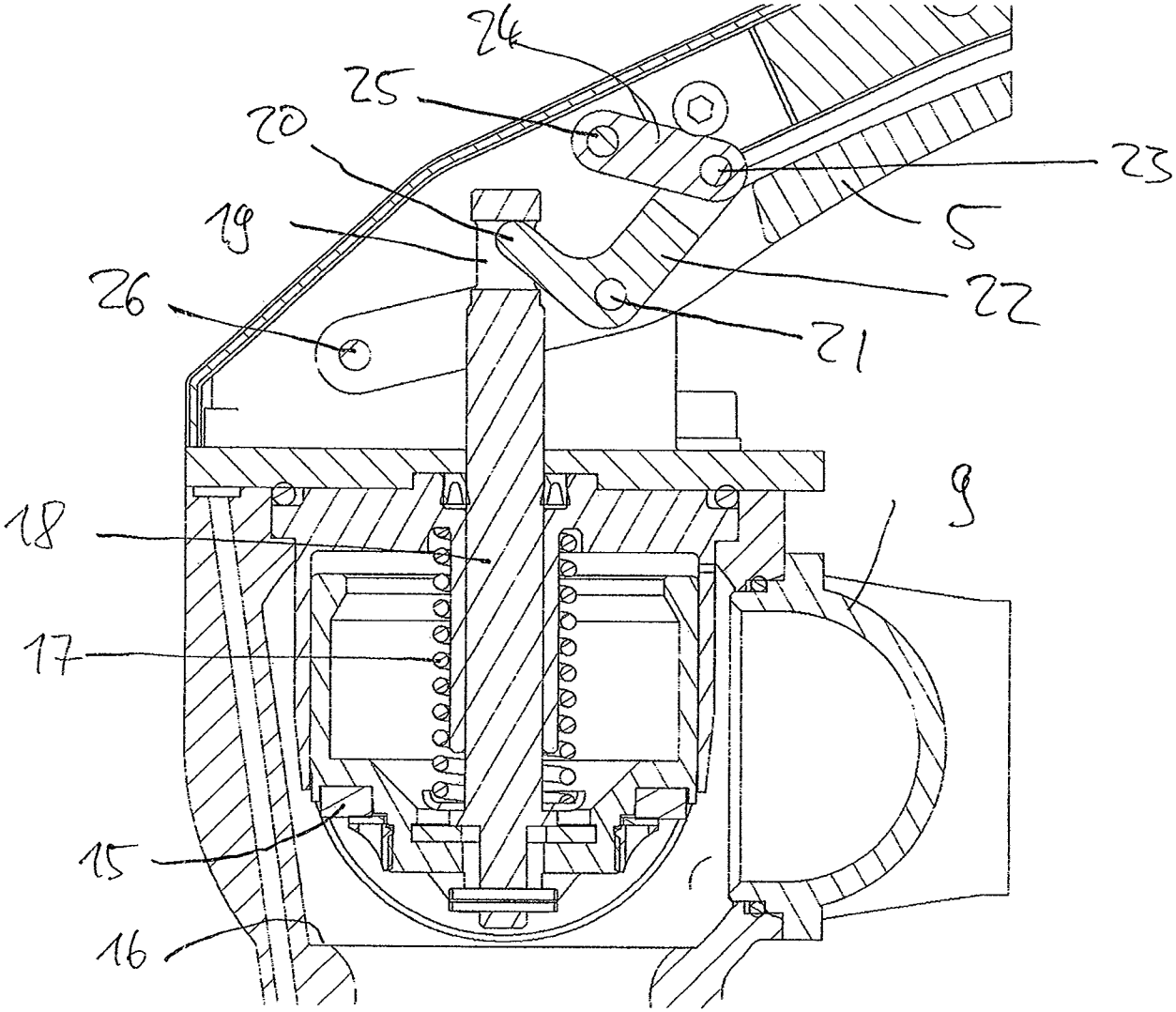
FIG. 5 in a section from FIG. 3, the dispensing valve in the open state.

FIG. 4 shows the dispensing valve in the closed state. The valve seal 15 is in liquid-tight contact with the valve seat 16. If the operating lever 5 is moved upwards from the rest position illustrated in FIG. 4, the pivot axis 21 of the drive lever 22 describes a circular arc, whose radius corresponds to the distance between the axis 26 of the operating lever 5 and the said pivot axis 21. Simultaneously, the distance between the axis 21 of the drive lever 22 and the axis 25 of the linkage lever 24 reduces as a result of the movement of the actuation lever 5, so that they carry out a rotary motion relative to one another about the axis 23. The drive lever 22 carries out a rotary motion relative to the operating lever 5 about the axis 21. The combination of the pivotal movements of the drive lever 22 about the axis 26 of the operating lever on the one side and the opposite pivoting motion about the axis 21 on the other side causes the actuation end 20 of the drive lever 22 to carry out an essentially linear upward movement and, resulting from the interaction in the bore 19, raises the valve rod 18 against the force of the spring 17 and opens the valve. It can be seen in FIGS. 4 and 5, that the kinematics of the coupled linkage mechanism are such that for on-going movement of the operating lever 5 through the mentioned opposite pivotal movements of the drive lever 22, the gear ratio of the coupled linkage mechanism is continuously reduced, so that at the start of the movement of the operating lever 5, a defined pivot angle about the axis 26 causes a smaller opening stroke of the valve than the same pivot angle about the axis 26 during the later course of the opening. The force ratio is correspondingly opposite.

It is also possible to design the dispensing valve in such a way that the gear ratio of the coupled linkage mechanism is continuously increased. Then a force ratio profile opposite to the illustrated example embodiment also results.

Figure 6:
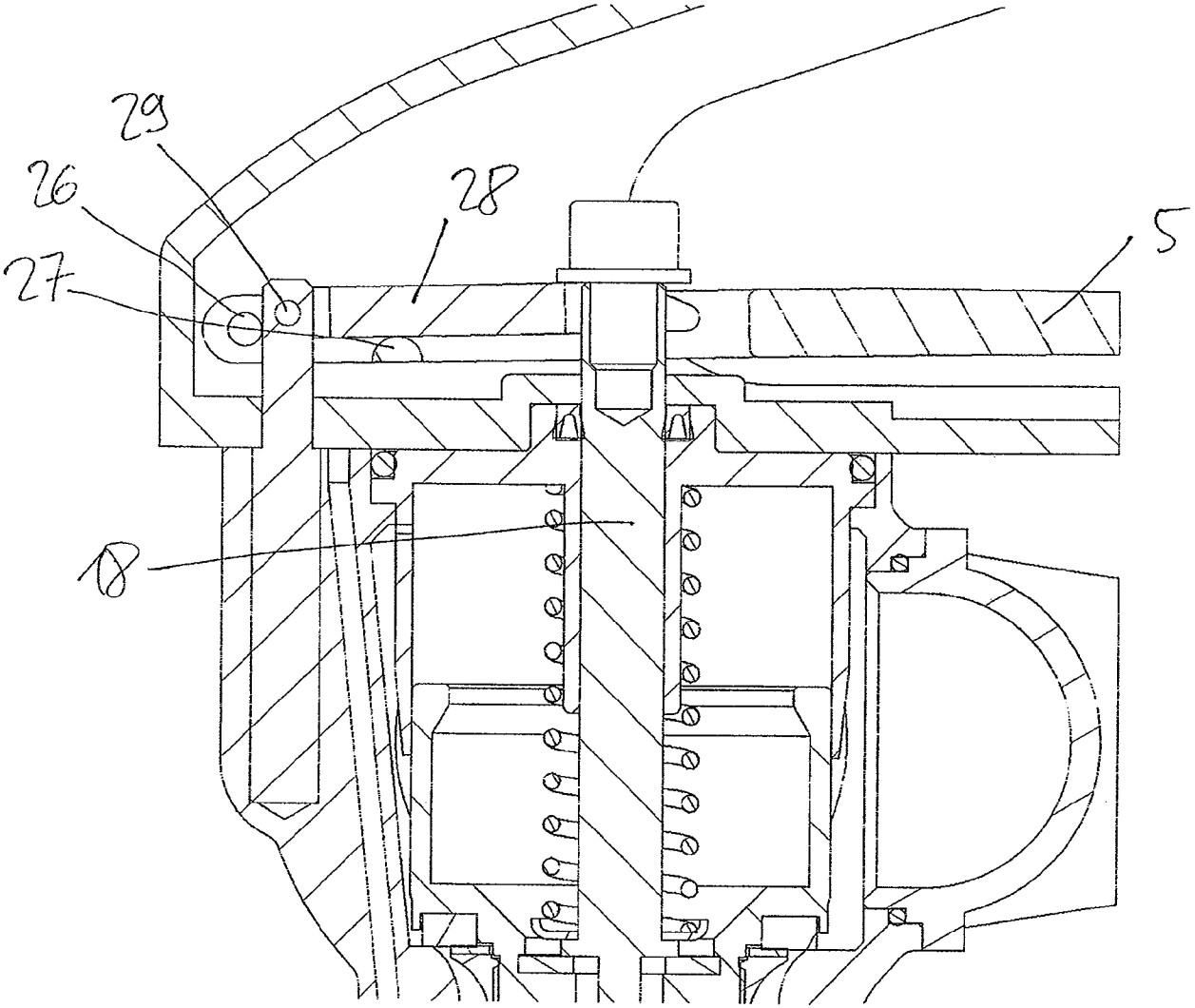
FIG. 6 a section of another embodiment with a rocker arm in the closed state.
Figure 7:
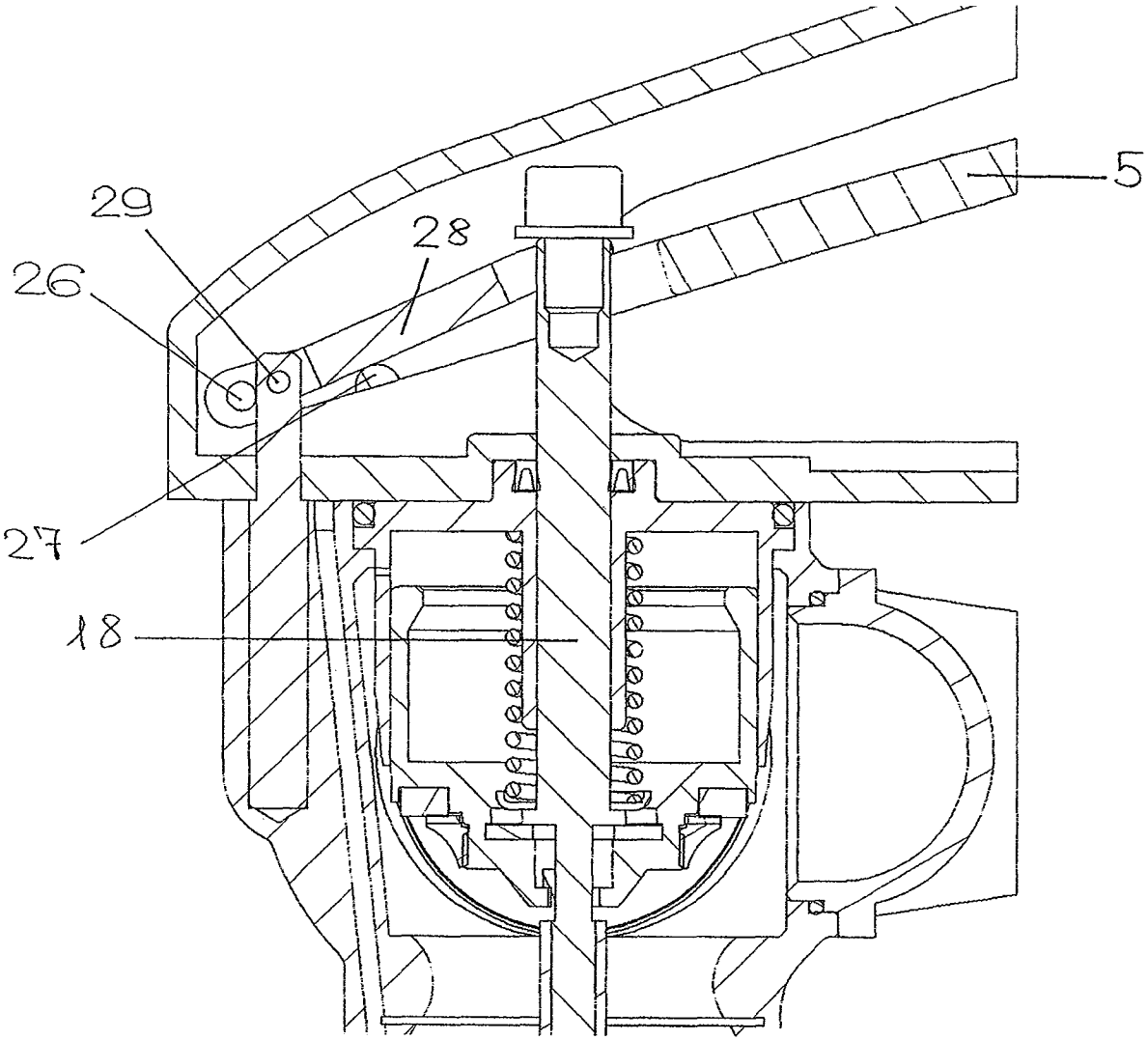
FIG. 7 the embodiment of FIG. 6 in the open state.

FIGS. 6 and 7 show a second embodiment of the invention, in which the coupled linkage mechanism comprises a rocker arm. The operating lever 5 has an operative connection via a protrusion 27 to a rocker arm 28, which is pivotably linked by the pivot axis 29. The rocker arm 28 has an operative connection at its end remote from the pivot axis 29 with a bore in the valve rod 18 and can lift the valve rod.

As can be seen from a comparison of FIGS. 6 and 7, when the operating lever 5 is moved its protrusion 27 lifts the rocker arm 28 and thus opens the valve. During this movement the protrusion 27 slides along on the underside of the rocker arm 28 and the distance between the pivot axis 29 and the point of action of the protrusion 27 on the rocker arm 28 reduces as a result of the relative arrangement of the pivot axis 26 of the operating lever 5 on one side and the pivot axis 29 of the rocker arm 28 on the other side. Through this reduction of the distance, the lever length reduces in such a way that at the start of the actuation process a defined angle change of the rocker arm 5 causes a smaller opening stroke of the valve than a pivoting motion of the operating lever 5 about the same angle during the continuation of the opening movement. A coupled linkage mechanism with variable gear ratio is thus achieved again.

In FIG. 3 it can be seen that the operating lever 5 comprises a retaining aid 30, which enables the operating lever 5 to be held open with reduced manual force in three open positions defined by detents 31 on the handle 4, as is described in EP 2 186 773 A1. The object of this application is made by reference thereto also the object of the present disclosure.

It is claimed:

1. A dispensing valve for dispensing liquids into a reservoir container, said dispensing valve comprising:

i) a main valve, and ii) an operating lever (5) designed for opening the main valve against a force that biases the main valve into a closed position, wherein a valve actuation mechanism of said dispensing valve has a continuous characteristic with a smooth profile, and with which, when applying an actuation force to the operating lever at the start of a valve opening stroke, a different opening force is exerted on the main valve than when the same operating force is applied to the operating lever during the later course of the valve opening stroke.

2. The dispensing valve of claim 1, wherein the operating lever (5) and the valve actuation mechanism of the main valve are kinematically connected via a coupled linkage mechanism whose gear ratio varies during the course of the actuation displacement of the operating lever (5).

3. The dispensing valve of claim 2, wherein the coupled linkage mechanism comprises a drive lever (22) linked to the operating lever (5), wherein a first actuation end (20) of said drive lever (22) has an operative connection to valve rod (18) of the main valve.

4. The dispensing valve of claim 3, wherein the drive lever (22) has a second end that is linked to a first end of a linkage lever (24), wherein a second end of said linkage lever (24) is linked to a fixed portion of the dispensing valve.

5. The dispensing valve of claim 4, wherein the first actuation end (20) of the drive lever (22) has an essentially linear guide.

6. The dispensing valve of claim 2, wherein the coupled linkage mechanism comprises a rocker arm (28).

7. The dispensing valve of claim 1, wherein valve body (3) comprises two mutually diametrically opposed inlets (2) connected to two inlet portions (7) of a dispensing valve housing.

8. The dispensing valve of claim 7, wherein the inlet portions (7) of the dispensing valve housing are pivotably connected to the inlets (2) of the valve body (3).

9. The dispensing valve of claim 7, wherein the inlet portions (2) of the dispensing valve housing extend in a fork-shaped manner from hose connection (1) of the dispensing valve to inlets (7) of the valve body (3).

10. The dispensing valve of claim 9, wherein a connecting path (8) is provided between the fork-shaped inlet portions.

11. The dispensing valve of claim 10, wherein the connecting path (8) is in the form of a liquid passage.

12. The dispensing valve of claim 10, wherein a viewing window (9) is provided in the valve body (3) or the connecting path (8).

13. The dispensing valve of claim 1, wherein said dispensing valve has a nominal width of at least 25 mm.

14. The dispensing valve of claim 1, wherein said dispensing valve has a nominal width of 40 to 50 mm.

15. The dispensing valve of claim 1, wherein said dispensing valve has a delivery performance of at least 150 l/min.

16. The dispensing valve of claim 1, wherein said dispensing valve has a delivery performance of at least 200 l/min.

17. The dispensing valve of claim 1, wherein said dispensing valve has a delivery performance of at least 300 l/min.

18. The dispensing valve of claim 1, wherein said dispensing valve has a delivery performance of at least 400 l/min.

19. The dispensing valve of claim 1, wherein said dispensing valve has a delivery performance of no more than 800 l/min.

20. The dispensing valve of claim 1, wherein said dispensing valve comprises a quick release pipe (6).

* * * * *